United States Patent [19]

Gorgius et al.

[11] 4,043,169

[45] Aug. 23, 1977

[54] TRIPLE ACTION CUPPING TOOL

[75] Inventors: Otto Gorgius, Mount Prospect; Dietmar G. Quaas, Arlington Heights, both of Ill.

[73] Assignee: Buhrke Industries, Inc., Arlington Heights, Ill.

[21] Appl. No.: 732,206

[22] Filed: Oct. 14, 1976

[51] Int. Cl.[2] ..... B21D 22/00

[52] U.S. Cl. ..... 72/349; 113/120 H

[58] Field of Search ..... 72/336, 347, 348, 349; 113/7 R, 7 A, 120 H

[56] References Cited

U.S. PATENT DOCUMENTS

| | | | |
|---|---|---|---|
| 3,405,546 | 10/1968 | Hoffman et al. | 72/348 |
| 3,470,725 | 10/1969 | Brown et al. | 72/336 |
| 3,786,667 | 1/1974 | Garnett, Jr. | 72/348 |
| 3,855,862 | 12/1974 | Moller | 113/120 H |
| 3,967,482 | 7/1976 | Kubacki et al. | 72/349 X |
| 3,986,382 | 10/1976 | Miller | 72/349 X |

*Primary Examiner*—Leon Gilden

*Attorney, Agent, or Firm*—John R. Diver; Chas. W. Rummler

[57] ABSTRACT

A cupping tool for use in a double acting press to perform the operations of blanking, drawing and redrawing of sheet stock in predetermined timing sequence to form a cup during each stroke of the press and wherein the successive punching operations of telescoping, draw and redraw punches are governed by means of an automatic punch interlock means wholly enclosed within the body of the tool and actuated by relative movement of the draw punch and the tool body.

5 Claims, 7 Drawing Figures

TRIPLE ACTION CUPPING TOOL

BACKGROUND OF THE INVENTION

In the manufacture of metal cans, it is the normal practice to blank and first draw sheet stock in one operation in one machine followed by a redraw operation which is performed in a separate machine called an ironing press wherein the diameter of the partly formed can is first reduced and then the draw of the can is completed. The can wall material is thinned out and the contour of the bottom of the can is formed by being drawn through three irons in the ironing press. The can is then ejected from the press and taken to the trimmer-flanger where the flange is flared to make the seam in readiness for putting on the end. Many such operations performed at different times in separate machines have resulted in much maintenance work and down time on the can production line, leading to unsatisfactory quality control in the manufacture of cans.

SUMMARY OF THE INVENTION

The gist of this invention lies in a cupping tool for use with presses having an outer slide which leads the stroke of an inner slide in degrees of slide crankshaft drive rotation and which combines the separate operations of blanking, drawing and redrawing into one press by means of a punch interlock mechanism which is self-actuating and self-contained within the body of the tool.

In the tool, a blanking die ring mounts on the outer slide of the press for vertical movement therewith and operationally, cooperates with an annular blanking punch which mounts on the bed of the press for the production of disks of flat material from which the cup or can is to be drawn.

Below the blanking die, and in concentric relation therewith, a first draw die, which is an integral part of the blanking punch, mounts on the bed of the press. Said first draw die operationally cooperates with an annular first draw punch which is slidably mounted within a draw pad within the blanking die ring. Said draw pad operates under the urging of a force bias which originates from the pressure of air on the piston of an air cylinder. Said force bias operates on the top surface of the flat disk material through the medium of the draw pad holding the flat material of the disk against the top of the blanking die during blanking and maintaining its centered position on the first draw die at the start of the first draw.

Below the first draw die and in concentric relation therewith, a redraw die mounts on the bed of the press. Said redraw die operationally cooperates with a redraw punch which telescopingly fits within the hollow cylindrical body of the first draw punch, having the flat bottom of its nose in flush relation with the flat bottom of the nose of the annular first draw punch during the first draw, and which cylindrically slides within the interior thereof with its nose extending out from the nose of the first draw punch in operational cooperation with the redraw die during redraw.

In the form of the apparatus herein shown, a 100° crankangle lead mechanism in the slide drive of the press combines with a punch interlock mechanism in the tool to coordinate the occurrence of the separate operations of blanking, first drawing and redrawing of the cup in the right sequence and at the right time. The blanking operation occurs at 10° before crankangle bottom dead center of the crankshaft drive of the outer slide in its stroke. The lift of the draw pad in the first drawing operation occurs at about 26° 40′ crankangle after the blanking operation. The lift of the first draw punch occurs at about 64° 35′ crankangle after the blanking operation. The redraw punch bottoms in its stroke 110° crankangle after the blanking operation and upon its return or upstroke, the first draw punch interlocks with the redraw punch at about 305° crankangle after the blanking operation.

As shown, the punch interlock mechanism comprises a latch which slidingly cooperates with the first draw punch to engage a groove in the upper shank of the redraw punch for interlocking the same. Said latch is urged to interlock said punches by the bias of an inwardly-acting radial force which originates from the pressure of air on the piston of an air cylinder working in the vertical direction. This radial force is transmitted as radial motion to the latch, for lockup of the punches, by a cam means, and positively interlocks the same by means of the operational cooperation of a vertically-disposed puch rod which contacts a fixed mechanical stop at the top of its stroke.

The latch of said punch interlock mechanism also slidingly cooperates with the first draw punch to disengage from the groove in the upper shank of the redraw punch for releasing the same to perform its redraw function. Said latch is urged to unlock the said punches by an outwardly-acting radial force which originates from the interaction of a cam on the latch with a mating cam which is mounted on the outer slide within the tool housing, the first working in a vertical direction relative to the second and transmitting radial movement to the latch for unlocking of the punches one from the other. While the form and operation of one latch is shown and described, at least three latches would normally be employed, as shown in FIG. 7.

DESCRIPTION OF THE PREFERRED EMBODIMENT

Figure 1:
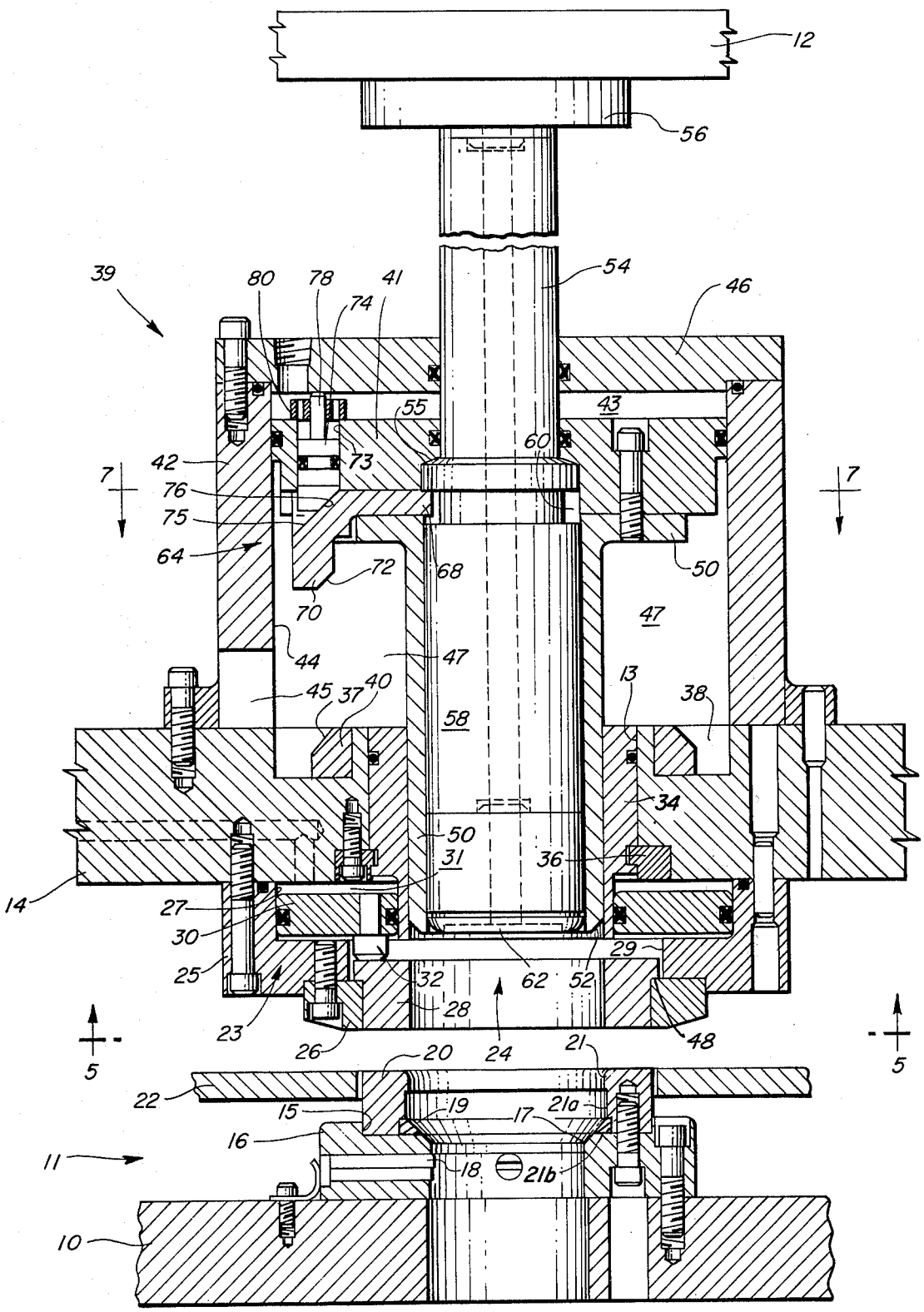
FIG. 1 shows a fragmentary elevational view of a cross-section of the blanking, drawing and redrawing tool of this invention at the first draw punch cam engaged position No. 5.
Figure 2:
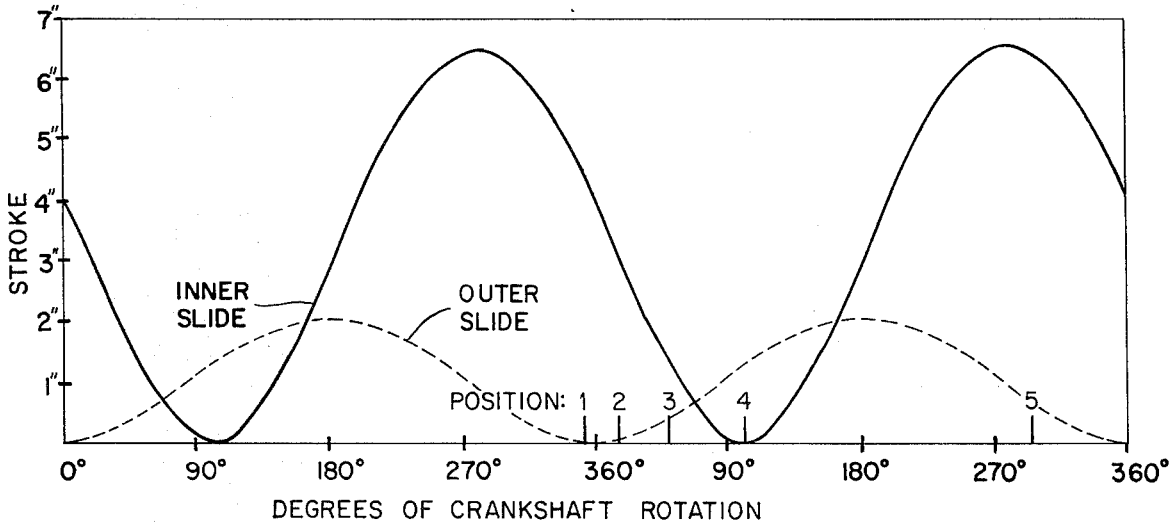
FIG. 2 shows a diagram of the outer slide and inner slide stroke versus degrees of crankshaft rotation for the type of double-acting cupping press to which the tool of this invention is applicable.

Reference to FIG. 1 shows the triple action draw and redraw tool for installation in a double-acting cupping press having phased inner and outer slide displacements versus crank-angle rotation diagrams, as shown in FIG. 2. A die shoe 10 mounts on the top surface of the press bed. A punch plate 12 is mounted on the bottom surface of the inner slide of said press and a punch-holder plate 14 having a large bore 13 therethrough is mounted on the outer slide thereof. A draw and redraw die assembly 11 is operationally mounted on the die shoe 10 comprising a redraw die retainer ring 16 which is supported by the top surface of the shoe 10 and which has spring-actuated stripper fingers 18 radially disposed therein for ejection of the cup stock from the redraw die assembly 11. A die bore 17 in the die retainer ring 16 bears a concentric relation with the large bore 13 in the punch holder plate 14.

A combination blanking punch and first draw die 20 is mounted in a recess 15 on the top surface of the redraw die and retainer ring 16 having its bore 21 and draw relief 21*a* both in concentric relation with the large bore 13. A second draw ring 19 is inserted in a recess 21*b* below and in adjacent concentric relation with the draw relief 21*a* on the top surface of recess 15 bearing a concentric relation with the large bore 13. A stripper plate 22 having its bore in vertical sliding relation with the cylindrical O.D. of the blanking punch 20 and its top surface in flush relation therewith slides relatively therealong as piloted on guideposts which are mounted on and extend vertically upwardly from the die shoe 10. Compression spring capsules (not shown) are inserted in the space between the stripper plate 22 and the die shoe 10 and force the stripping of the cup stock from the die assembly 11.

A punch assembly 24 operationally depends from the punch plate 12 and extends downwardly through the punch-holder plate 14 and comprises a draw pad-actuating air cylinder and cup stock-locating plate 25 which is mounted on the bottom face of holder 14 having a small bore 29 therethrough which bears a concentric relation with bore 13. A large cylindrical bore 27 in the plate 25 opening to the bottom face of the punch-holder 14 bears a concentric stepped relation with the small cylindrical bore 29 located therebelow.

A blanking die ring 26, having its I.D. working in blanking relation with the O.D. of the blanking punch 20, bears a concentric relation with the large bore 13 in the punch-holder plate 14 and an annular draw pad 28 works its O.D. in sliding relation with the die ring 26, its bottom face nominally bearing a flush relation with the bottom face of the same. A shoulder 48 surrounds the top of pad 28 and bears against the top surface of die ring 26 which serves to hold the cut blank flat during the first draw.

An annular draw pad-actuating piston 30 operationally slides within the large cylindrical bore 27 of the air cylinder 25, which is normally provided with 40–60 psig air pressure introduced in the first air cavity 31 between the top surface of said piston 30 and the bottom surface of the punch-holder plate 14, and a plurality of buttons 32, mounting on the bottom side of said piston 30, bears on the top face of draw pad 28 for transmitting operating pressure to the said draw pad.

An annular bronze bushing 34 has a large O.D. section which slip fits within the large bore 13 in the punch-holder plate 14 and a split ring 36 retains said bushing 34 therein. A smaller O.D. section on said bushing 34 which steps down from the large O.D. section and has a diameter which is only slightly greater than that of the die bore 21 extends down below the bottom face of the punch-holder 14 for sliding engagement of the I.D. of annular piston 30.

An annular groove 38 extends down into the top face of punch-holder 14, bearing a concentric relation with bore 13, and has an I.D. which is slightly greater than the O.D. section of the bronze bushing 34 and a ring 40, having a 45° cam 37 chamfering the intersection of the top corner and O.D. thereof, slip fits into said groove 38 over the I.D. of the same and bears a precise vertical location with respect to the relative position of the punch plate 12 and the holder plate 14 in their respective displacements according to FIG. 2.

A punch-biasing air cylinder 39 is operationally mounted on the top surface of punch-holder 14 and has a cylindrical bore 44 which opens to the top surface of punch-holder plate 14 and bears a concentric relation with the bore 13 which is slightly greater than the O.D. of the annular groove 38. An annular punch-biasing piston 41 operationally slides within the bore 44 of the air cylinder 39 and the draw punch assembly 24 operationally depends from the bottom surfaces of the piston 41 and the punch plate 12 in concentric sliding relation therewith. A cylinder head 46 caps the top end of the cylinder wall 42 and the air cavity 43 thereunder, above the top surface of piston 41, is normally provided with 50 to 70 psig air pressure. An air relief aperture 45 vents the air cavity 47 under the bottom face of said piston 41.

The draw punch assembly 24 comprises an annular first draw punch 50 having a nose 52 at the lower end thereof and having its top end flange-mounted to the bottom surface of the piston 41. First draw punch 50 slidingly operates its O.D. within the bore in the annular bronze bushing 34, in concentric relation with bore 13, and extends below the lower end thereof for engaging a drawing relation with the die bore 21.

A cylindrical post 54 flange-mounts at its top end on the bottom face of the draw punch plate 12 and bears a concentric relation with the bore 13, said post 54 being retained to plate 12 by a collar 56. A cylindrical redraw punch 58 extends from the lower end of the post 54 and forms a shoulder element 55 therewith which bears against a counterbore in piston 41 in concentric relation with the bore 13. A groove 60 circumferentially extends around the top end of said punch 58 below and adjacent to the shoulder element 55 at the juncture between the punch post 54 and the punch 58. A redraw punch nose 62 is mounted on the bottom end of the punch 58 in concentric relation therewith and bears a flush relation during the first draw operation with said annular punch nose 52 on the first draw punch 50.

Figure 7:
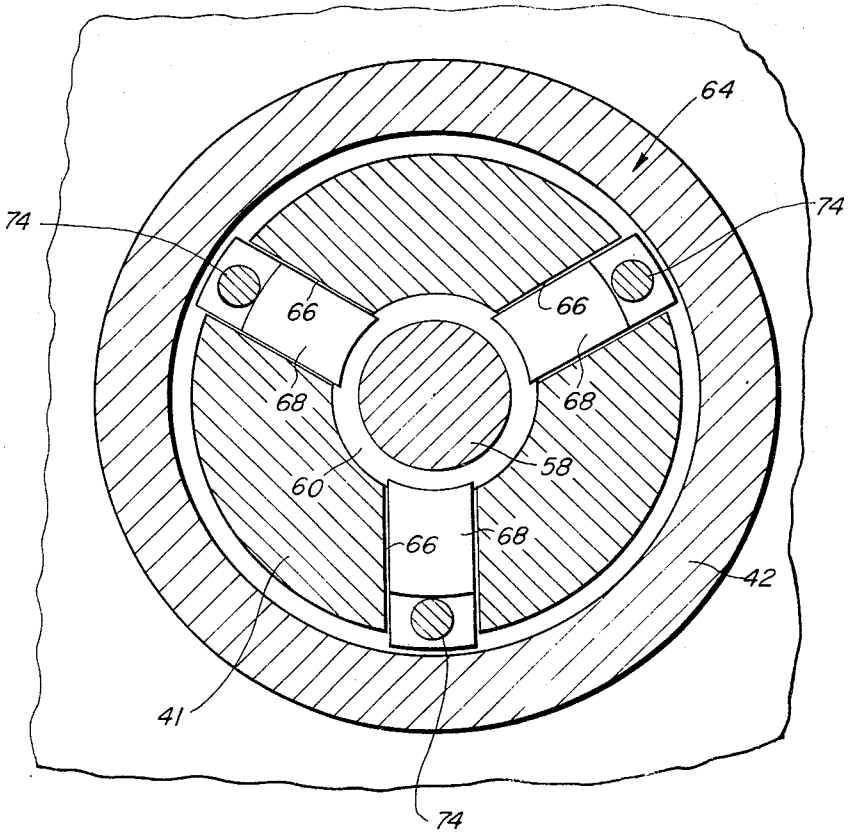
FIG. 7 shows a fragmentary horizontal view of a crosssection taken along the line 7—7 of FIG. 1.

A punch latching mechanism 64 is operationally disposed between the top flange of the first draw punch 50 and the bottom surface of the piston 41 for coordinating the first draw and redraw operations in the proper operating sequence. As shown in FIG. 7, the latching mechanism 64 comprises three radially-extending grooves 66 formed in the bottom surface of piston 41 which are equally spaced around the central bore therein. The grooves 66 open to the center bore of said piston 41 and to the O.D. therearound and latches 68, each having concave circular inner nose ends and each radially sliding within a respective groove 66, engage and disengage the first draw punch 50 and the redraw punch 58, one to and one from the other, at the right time and in the proper sequence.

Figure 4:
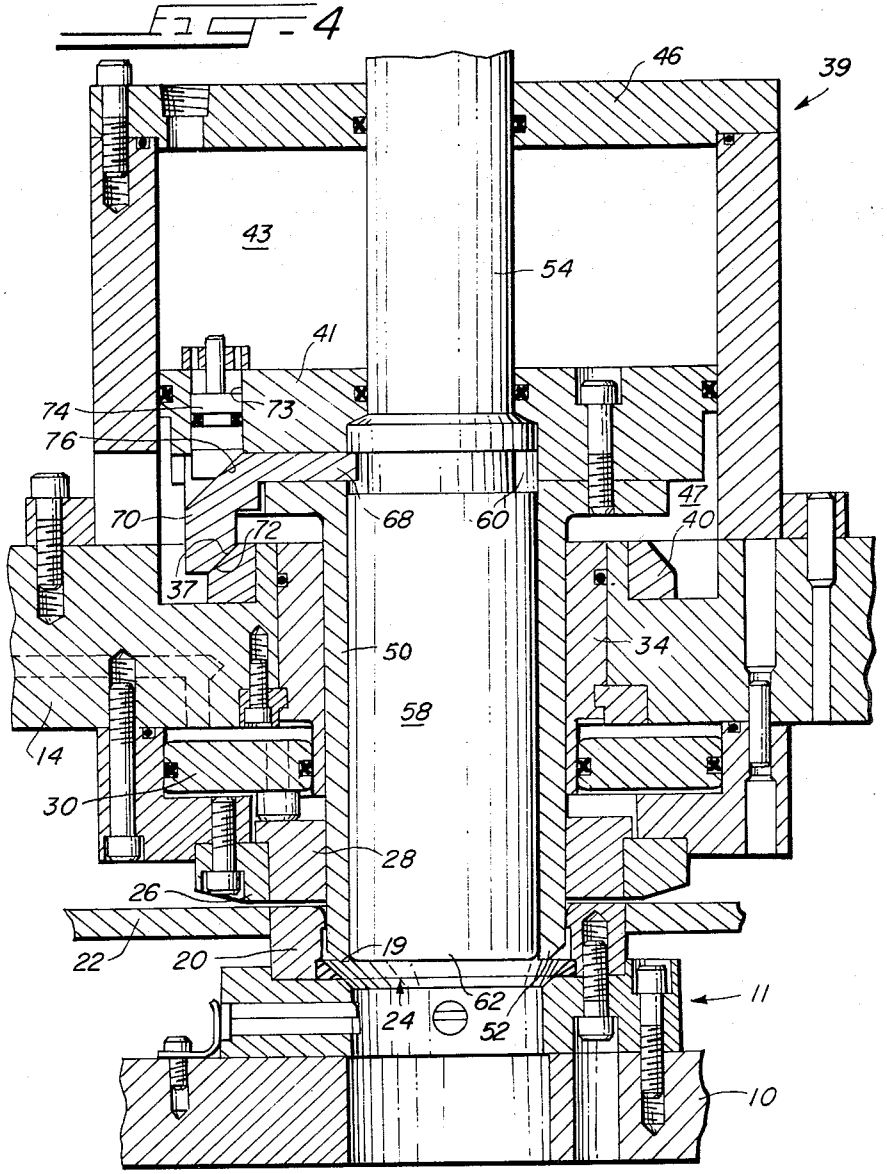
FIG. 4 shows the same for lift of the draw pad position No. 2.

A tang element 70 extends downwardly from the radially-extending outer end of each of said latches 68 each tang having a 45° cam 72 chamfering the intersection of the bottom and I.D. surfaces thereof for engagement with the cam on the cammed ring 40 at a precise vertical location with respect to the relative position of the punch plate 12 and the holder plate 14 in their respective displacements according to FIG. 4. Also, a 45° cam 75 chamfers the intersection of the top and O.D. portion of the cammed tang element 70 on each latch 68 to serve as a return means for effecting latching engagement of the latches with the redraw punch 58.

A latch biasing piston 74 operationally slides in a bore 73 which extends through the top piston 41, the bore opening to the 50–70 psig air pressure in air cavity 43. A 45° cam 76 chamfers the intersection of the bottom of the latch return piston 74 for engagement with the 45° cam 75 on the tang element 70 and a pushrod 78 extends axially from the top of latch biasing piston 74 for contacting the bottom side of cylinder head 46 when the piston 41 is uppermost in its vertical movement and the punch assembly 24 is fully retracted. A ported guide 80 is mounted on the top side of piston 41 for slidingly guiding the pushrod 78 upon its engagement with the cylinder head 46 and its downward movement for biasing of the latch 68 to interlock the first draw puch 50 and the redraw punch 58, as will be hereafter explained.

Figure 3:
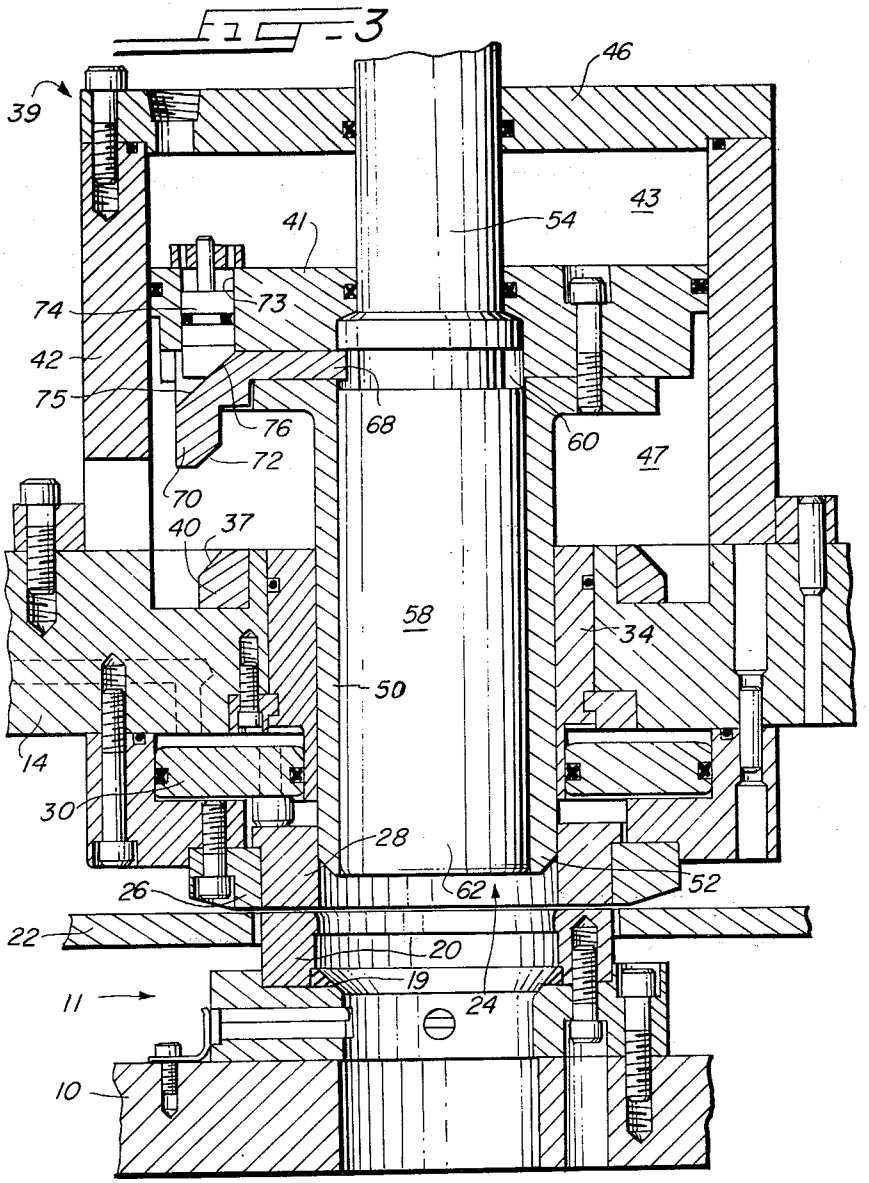
FIG. 3 shows a fragmentary elevational view of a crosssection of the blank, draw and redraw tool in stock blanking position No. 1.

In the operation of the triple action blanking draw and redraw tool, as herein shown and described, reference to FIG. 2 shows stroke displacement diagrams for the blank ram and the draw ram in terms of degrees of crankshaft rotation. Starting from top dead center, the outer slide of the press lowers blanking die ring 26 to position No. 1 above blanking punch 20 for cutting stock, as shown in FIG. 3. The outer slide, with punch-holder 14 mounting thereto, is practically stationary in its stroke and the bottom surface of the draw pad 28 bears on the top surface of the blanking punch 20 with the cut-stock retained therebetween. Pad 28 is urged by the buttons 32, which protrude from the bottom surface of the piston 30 and bear on the top surface of pad 28, under the 40–60 psig air pressure in the first air cavity 31 above the lower piston 30, to bottom its shoulder 48 therearound against the top surface of die ring 26. The inner slide of the press carries draw punch plate 12 and drawing punch assembly 24 and has both the first draw and the redraw punches 50 and 58, respectively, depending therefrom in the mutually locked-up position. First draw punch 50 and redraw punch 58 are in mutually locked-up positions when the nose portions of latches 68, which slidingly mount in the first draw punch 50, engage the groove 60 in the redraw punch 58 and the noses 52 and 62 of draw and redraw punches 50 and 58, respectively, are in approximate mutually flush relation.

Under the urging of the 50–70 psig air pressure in air cavity 43 on latch-return piston 74, cam 76 on latch biasing piston 74 bears on cam 75 of tang 70 to bias the latches 68 radially inward and with the engagement of the push rod 78 with cylinder head 46 forces the retention of the nose portion of latches 68 in the groove 60 for lock-up of the punch assembly 24.

With the punch assembly locked-up, the inner slide lags the outer slide during motion on the way down from position No. 1 to a position in its stroke almost midway to the bottom thereof, according to FIG. 2, and lift of first draw pad 28 off cut-stock between it and punch 20 begins as shown in FIG. 4. In position No. 2 completing the lift of first draw pad 28, the outer slide of the press with punch-holder 14 is just starting on the way up, according to the outer slide displacement diagram, as shown in FIG. 2, and as the outer slide rises it lifts the bottom surface of the first draw pad 28 off the cut-stock which rests on the top surface of the blanking punch 20. The inner slide of the press with drawing punch assembly 24, which still has first draw and redraw punches 50 and 58 in mutually locked-up position, is on the way down and just past midway to the bottom of its stroke lagging the outer slide, according to FIG. 2. First draw punch 50 is now in drawing engagement with first draw die 20, having the cutstock drawn therebetween, and the nose portions of latches 68 are in sliding engagement with the first draw punch 50 and top piston assembly 41 still engages groove 60 in redraw punch 58 for locking the nose of first draw punch 50 in flush relation with the nose of redraw punch 58. Cam 76 on latch biasing piston 74 retains latch 68 in groove 60 for the lock-up until the cam 74 on tang 70, on each of the latches 68, incipiently engages cam 37 on ring 40 for beginning the disengagement of the first draw punch from the redraw punch 58.

Figure 5:
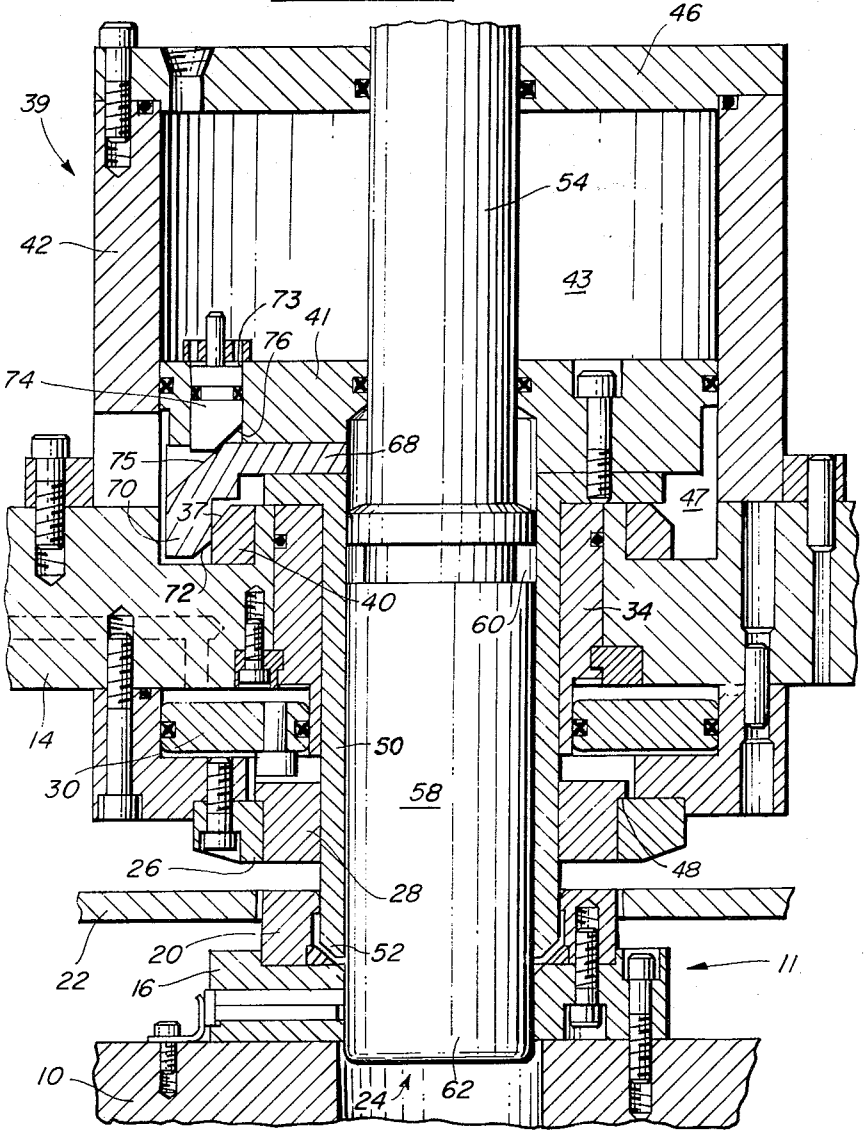
FIG. 5 shows the same for lift of the first draw punch position No. 3.

In position No. 3 completing the lift of the first draw punch operation, as shown in FIG. 5, the outer slide of the press is moving up, according to FIG. 2, and lifting the blanking die ring 26 from blanking engagement with the blanking punch 20. The inner slide of the press, which carries the draw punch plate 12 and drawing punch assembly 24, now has the first draw punch 50 unlocked from redraw punch 58, and the redraw punch 58 approaches the bottom of its stroke, according to FIG. 2. At this point, first draw punch 50 has completed its drawing engagement with first draw die 20 and is being withdrawn, and redraw punch 58 has practically completed its drawing engagement with bore 17 of the redraw die 16 and the second draw ring 19 inserted thereabove.

Figure 6:
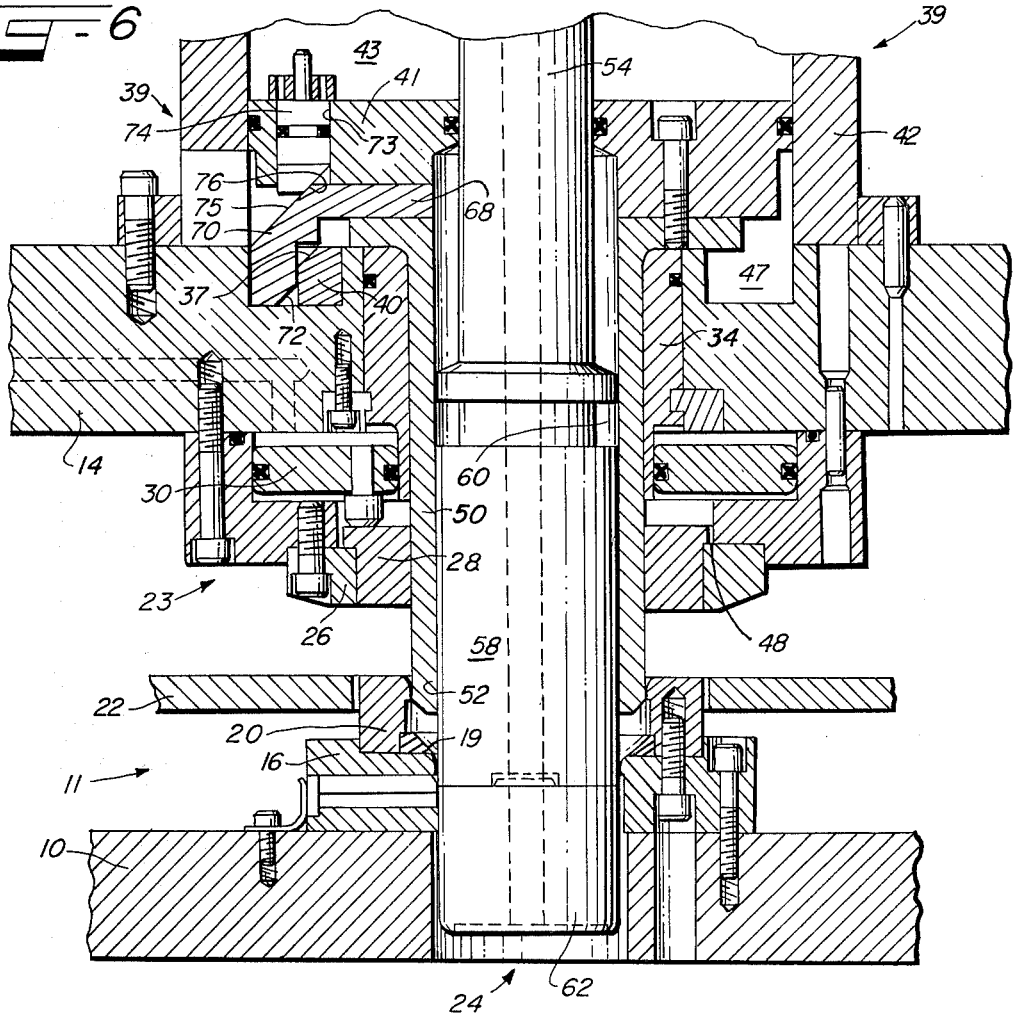
FIG. 6 shows the same for the redraw punch at bottom stroke position No. 4.

In the redraw punch bottom stroke position No. 4, as shown in FIG. 6, the outer slide of the press is moving up, according to FIG. 2, and the nose portion 52 of the first draw punch 50 is lifting out of drawing engagement with the first draw die 20. The inner slide of the press has first draw punch 50 unlocked from redraw punch 58 by the retraction of the nose portion of latches 68 and the 50–70 psig air pressure in air cavity 43 acting on the top surface of piston 41 holds said piston 41 and draw punch 50 attached thereto in engagement with the outer slide in its upward movement. The redraw punch 58 has completed its drawing engagement with the second draw ring 19 and the redraw die bore 17 and is practically stationary in the movement of its stroke ready also to begin its upward movement.

As shown in FIG. 2, the outer slide of the press soon begins to move down in its stroke carrying piston 41 and first draw punch 50 attached thereto. Meanwhile the inner slide with the redraw punch 58 continues in an upwardly movement in relation to the outer slide resulting in the shoulder 55 on punch 58 contacting the counterbore in the bottom of piston 41 and punch 58 carrying piston 41 and punch 50 attached thereto as a unit leading to the first draw punch cam engagement position No. 5, which completes the lock-up of first draw punch 50 and redraw punch 58, as shown in FIG. 1. FIG. 2 then shows the outer slide of the press at a crank angle after bottom dead center and moving down and the inner slide thereof lagging the outer slide putting it just after top dead center. This puts the top surface of piston 41 at a position in closest relation to the bottom surface of cylinder head 46 and the top end of pushrod 78 contacts the bottom surface thereof forcing cam 76 on latch return piston 74 against cam 75 on latch 68 and driving the nose portion of said latch 68 into groove 60 for the lock-up of first draw punch 50 and redraw punch 58, ready to begin the cycle anew.

Although but one specific embodiment of this invention is herein shown and described, it will be understood that details of the construction shown may be altered or omitted without departing from the spirit of the invention as defined by the following claims.

We claim:

1. In a double-acting cupping press having a bed, an outer slide and an inner slide, the outer slide leading the stroke of the inner slide in degrees of slide-drive crankshaft rotation, the combination with said press of a triple-action blank, draw and redraw cupping tool having a stripper plate which is mounted on a die shoe supported by the press bed, a blanking-die-holder plate mounted on the outer slide of the press, and a draw and redraw punch-holder plate mounted on the innter slide thereof comprising:

a. a punch for blanking, a die for drawing and a redraw die for redrawing mounted on the die shoe on a common centerline in mutually orientated vertical configuration for cooperation thereon in the successive operations of blanking, drawing and redrawing;

b. a blanking die mounted on the blanking dieholder plate for cooperating with the blanking punch in the operation of blanking;

c. an annular draw punch slidingly mounted in the blanking die-holder plate for cooperating with the draw die in the operation of drawing;

d. a redraw punch depending from the draw and redraw punch-holder plate and sliding within the annulus of said draw punch therethrough for operationally cooperating with the redraw die in the operation of redrawing;

e. a latch mounted on said draw punch having biasing means for engaging said latch in a groove in said redraw punch and interlocking the draw punch with the redraw punch; and f. a cam means mounted on said latch and said blanking-die-holder plate for operationally disengaging said draw punch from said redraw punch.

2. In the combination cupping press and blank, draw and redraw tool, as set forth in claim 1, wherein the latch interlocking bias means comprises:

a. a source of pressure;

b. a first cam on said latch;

c. a latch biasing piston having one end in fluid communication with said source of pressure; and d. a second cam on the other end of said piston operationally sliding against said first cam.

3. In the combination cupping press and blank, draw and redraw tool, as set forth in claim 1, wherein the cam means comprises:

a. a third cam supported by said punch-holder plate; and b. a fourth cam fixedly mounting on said latch arranged for operationally sliding against said third cam.

4. In the combination cupping press and blank, draw and redraw tool, as set forth in claim 2, wherein the improvement in latch interlocking bias means comprises:

a. a mechanical stop mounted on said blanking-die-holder plate; and b. a pushrod extending from said one end of said latch biasing piston for operationally contacting said mechanical stop.

5. In a cupping press having a bed and an outer slide leading the stroke of an inner slide in degrees of slide-drive crankshaft rotation, the combination with said press of a blank, draw and redraw cupping tool having a source of pressurized air, a die shoe having a shoe and guideposts extending upwardly therefrom mounted on said bed; a stripper plate slidingly mounted on the guideposts having a first bore in concentric relation with said bore in said shoe and compression springs between it and said die shoe; a punch-holder plate mounted on the outer slide of said press having a bore in concentric relation with said bore in said shoe; and a draw punch plate mounted on the inner slide of said press, comprising:

a. a redraw die ring mounted on the die shoe in concentric relation with said bore therein having radially-disposed spring-biased stripperfingers for ejecting the redraw cups therefrom;

b. a draw die mounted on top of said redraw die ring in concentric relation therewith;

c. a blanking punch mounted on top of said draw die in concentric relation therewith in said bore in said stripper plate sliding thereabout;

d. an annular cut-stock holding air cylinder in concentric relation with said bore in said shoe mounted on the bottom of said punch-holder plate;

e. a blanking die ring mounted on the bottom of said annular cut-stock holding air cylinder in concentric relation with said bore in said shoe;

f. an annular draw pad slidingly mounted in the bore in said blanking die ring in concentric relation with said bore in said shoe having a shoulder around the top;

g. an annular cut-stock holding piston slidingly mounted in the bore of said annular cut-stock ejection air cylinder in concentric relation with said bore in said shoe and having its bottom surface bearing on the top of said draw pad through buttons mounted thereon, and having an air cavity above its top surface in fluid communication with the source of air pressure;

h. an annular punch-biasing air cylinder in concentric relation with said bore in said shoe mounted on the top of said punch-holder plate;

i. an annular punch-locating cylinder head mounted on top of said annular punch-biasing cylinder having a bore in concentric relation with said bore in said shoe;

j. an annular punch-biasing piston slidingly mounted in the bore of said annular punch-biasing air cylinder having a counterbore in the bottom thereof in concentric relation with the bore in said shoe and having an air cavity above its top surface in fluid communication with the source of air pressure;

k. three equally-spaced latches, each having a nose portion projecting inwardly in a radial direction and each slidingly-mounted in radiallyextending grooves in the bottom of the annular punch-biasing piston, and each having punch engaging and disengaging cams mounted thereon;

l. an annular draw punch having a flanged top for mounting to the bottom of said annular punchbiasing piston;

m. a redraw punch slidingly mounted in said annular draw punch having a post of smaller diameter mounted at one end to and in concentric relation with the redraw punch at the juncture thereof and at the other end depending from said draw punch plate;

n. a groove in said redraw punch spaced from the shoulder for engaging said nose portions of said latches;

o. latch biasing pistons each slidingly engaging a respective small bore in said annular punch-biasing piston eccentric to said bore in said shoe having pushrods extending upwardly from the tops thereof and having cam surfaces mounted on the bottoms thereof for operationally sliding on each of the punch engaging cams on said latches; and p. a cam ring mounted on the top of the punchholder plate and having a cam for operationally sliding on each of the punch-disengaging cams on said latches.

* * * * *